United States Patent [19]

Jerila

[11] Patent Number: 4,631,894

[45] Date of Patent: Dec. 30, 1986

[54] HARDWARE FOR PANEL DOORS

[75] Inventor: Torsti T. T. Jerila, West Covina, Calif.

[73] Assignee: Acme General Corporation, San Dimas, Calif.

[21] Appl. No.: 371,546

[22] Filed: Apr. 26, 1982

[51] Int. Cl.[4] ..... E04C 2/38

[52] U.S. Cl. ..... 52/823; 52/656; 52/475; 52/717.1; 52/241

[58] Field of Search ..... 52/475, 823, 656, 657, 52/397, 825, 826, 241, 821, 822, 716, 717

[56] References Cited

U.S. PATENT DOCUMENTS

| | | | |
|---|---|---|---|
| 2,096,076 | 10/1937 | Ver Meulen | 52/717 |
| 2,115,130 | 4/1938 | Thurn | 52/823 |
| 2,163,259 | 6/1939 | Moore | 52/584 |
| 2,663,390 | 12/1953 | Dordel | 52/823 |
| 2,940,805 | 6/1960 | Nordmark | 52/823 |
| 3,058,173 | 10/1962 | Brydolf | 49/411 |
| 3,261,129 | 7/1966 | Brydolf | 49/411 |
| 3,374,578 | 3/1968 | Mesnel | 52/716 |
| 3,382,615 | 5/1968 | Adell | 52/716 |
| 3,397,495 | 8/1968 | Thompson | 52/241 |
| 3,479,768 | 11/1969 | Smadja | 52/716 |
| 3,838,548 | 10/1974 | Tanner | 52/656 |
| 3,934,385 | 1/1976 | Paulus | 52/717 |
| 3,969,864 | 7/1976 | Stephenson | 52/475 |
| 4,007,536 | 2/1977 | Soderberg | 52/717 |
| 4,326,365 | 4/1982 | Svensson | 52/471 |
| 4,361,994 | 12/1982 | Carver | 52/241 |

FOREIGN PATENT DOCUMENTS

| | | | |
|---|---|---|---|
| 838970 | 7/1949 | Fed. Rep. of Germany | 52/716 |
| 1022781 | 1/1958 | Fed. Rep. of Germany | 52/823 |
| 2103906 | 1/1971 | Fed. Rep. of Germany | 52/716 |

*Primary Examiner*—William F. Pate, III
*Assistant Examiner*—Caroline Dennison
*Attorney, Agent, or Firm*—Christie, Parker & Hale

[57] ABSTRACT

A panel door comprising framing members, corner connectors and a door panel is disclosed. The framing members comprise a side wall and spaced apart first and second walls extending generally normal to the side wall. The first and second walls form a channel. The framing member comprises a deflection arm which is deflected by and which generates a return force against a door panel having an edge inserted into the front channel. Preferred framing members have a generally "E" shaped cross section and comprise a side wall and spaced apart front, intermediate and rear walls, the front and intermediate walls form a front channel and the intermediate wall comprises a deflection arm. The deflection arm of preferred stiles extends from a pivot position between the edges of the intermediate wall toward the front and side walls. The deflection arm of preferred rails is bent at a position between its edges and extends from the bend away from the side wall and toward the plane of the front wall.

46 Claims, 8 Drawing Figures

HARDWARE FOR PANEL DOORS

FIELD OF THE INVENTION

This invention relates to framing hardware for panel-type doors and more particularly to improved rails and stiles for such doors.

BACKGROUND OF THE INVENTION

Panel-type doors consisting of a single generally-flat panel and appropriate framing hardware surrounding the panel have found a great deal of use as closet doors, cabinet doors and the like. The opening mechanism for such doors may be by means of hinges connecting one side of the door to one side of the doorway or may involve upper and/or lower tracks on which the door slides or rolls. Of these, the opening mechanism may involve a double-door in which one door slides to one side in front of or in back of another adjacent door, thereby opening a portion of the doorway. Alternatively, the doors of the double door may be connected by hinges which allow the doors to open by folding. This latter type is often referred to as a bi-fold door.

The framing hardware for such panel doors includes horizontal rails and vertical stiles for the ends and sides, respectively, of the panel. The rails and stiles of conventional panel-type doors each have a channel that receives the edges of the panel. The rails and stiles are connected at each corner by corner connectors positioned in back of the panel.

The stiles of such door panels need to have a good stiffness to minimize twisting or bending that could release the panel from the stile. Any force exerted on the stile in a direction away from the panel such as a force exerted on the stile for opening or closing a panel door may pull the stile away from the panel. This may result in the panel coming out of the corresponding channel in the stile or in the stile becoming bowed. This problem is accentuated by heavy panels such as glass or mirror panels because the forces acting on the framing hardware are greater.

A conventional solution to this problem has been to make the channel in the stile sufficiently deep to prevent the edge of the panel from slipping out of the channel. However, this creates a situation in which the face or front wall of the rails and stiles is very wide. For very large doors, the width of the faces of the rails and stiles does not significantly detract from the appearance of the door. But for small or narrow doors, the area of stile faces relative to the area of the door panel becomes increasingly significant and increasingly detracts from the appearance of the door. This is especially significant for glass panel doors or mirror panel doors.

For example, in a bi-fold door there may be four mirror panels in an opening four foot wide or even less. A conventional stile has a face about $\frac{7}{8}$ inch wide. Thus, about seven inches of the width of the door is occupied by the faces of the stiles. There is a vertical band almost two inches wide between each mirror which becomes quite distracting and unattractive. What one sees is a mirror subdivided by three wide stripes of metal. The effect is even more exaggerated when the opening is narrower and the mirror panels are narrower.

There is a need for stiles and rails to grip the panels of such doors which would not only prevent the panel from slipping out of the channel but would also add stiffness and rigidity to the door, therefore alleviating the need for auxiliary door stiffners. There is a competing need, however, to reduce the face area of the stiles and rails, particularly the stiles, so that they do not unduly detract from the appearance of the door, especially smaller or narrower doors.

SUMMARY OF THE INVENTION

In accordance with the present invention, there is provided hardware for a panel door comprising four framing members for the edges of a door panel and four corner connectors for interconnecting the framing members.

Each framing member comprises a side wall and a front wall and third wall generally normal to the side wall. The front and third walls are spaced to form a channel which is sufficiently wide to receive an edge of a door panel. The ratio of the width of the front wall to the width of the channel is preferably no more than about 3.

Each framing member further comprises a resilient deflection arm. When an edge of a door panel is inserted into the channel, the deflection arm which is behind the panel is deflected by the door panel and generates a return force against the door panel.

Preferred framing members have a generally "E" shaped transverse cross section and each comprises a side wall and front, intermediate and rear walls generally normal to the side wall. The front and intermediate walls are spaced apart to form a front channel which is sufficiently large to receive an edge of the door panel. The intermediate and rear walls cooperate to form a rear channel that provides strength and rigidity to the framing member and is sufficiently wide to house the corner connectors. The intermediate wall comprises a resilient deflection arm which is deflected by and which generates a return force against the back of a door panel inserted into the front channel.

In a first preferred embodiment of a framing member which can be used as a stile, the deflection arm is integral with the intermediate wall and extends from a pivot position between the edges of the intermediate wall toward the front and side walls. The deflection arm extends into the front channel sufficiently that the distance between the front wall and the contact edge of the deflection arm is less than the thickness of the door panel. Thus, the deflection arm is deflected away from the front wall when the edge of a door panel is inserted into the front channel. The return force generated by the deflection arm is sufficient to grip the door panel without damaging it.

In a second preferred embodiment of a framing member which can be used as a rail, the intermediate wall forms a deflection arm which is bent at a position intermediate its edges and extends away from the side and rear walls sufficiently to be deflected by and to generate a return force against a door panel having an edge inserted into the front channel.

The edges of the door panel are inserted into the front channel of the corresponding framing members. The corner connectors rigidly connect each pair of framing members forming a corner of the panel door.

A particularly preferred embodiment comprises hardware for a panel door comprising a pair of stiles constructed according to the first preferred embodiment, a pair of rails constructed according to the second preferred embodiment and four corner connectors.

Panel doors constructed according to the present invention are particularly suitable for use in folding door systems, sliding door systems and the like.

Brief Description of the Drawings

These and other features and advantages of the present invention will be better understood by reference to the following detailed description when considered in conjunction with the accompanying drawings wherein.

DETAILED DESCRIPTION

A preferred embodiment of the invention comprises framing members for a bi-fold door system with mirror panels.

Figure 1:
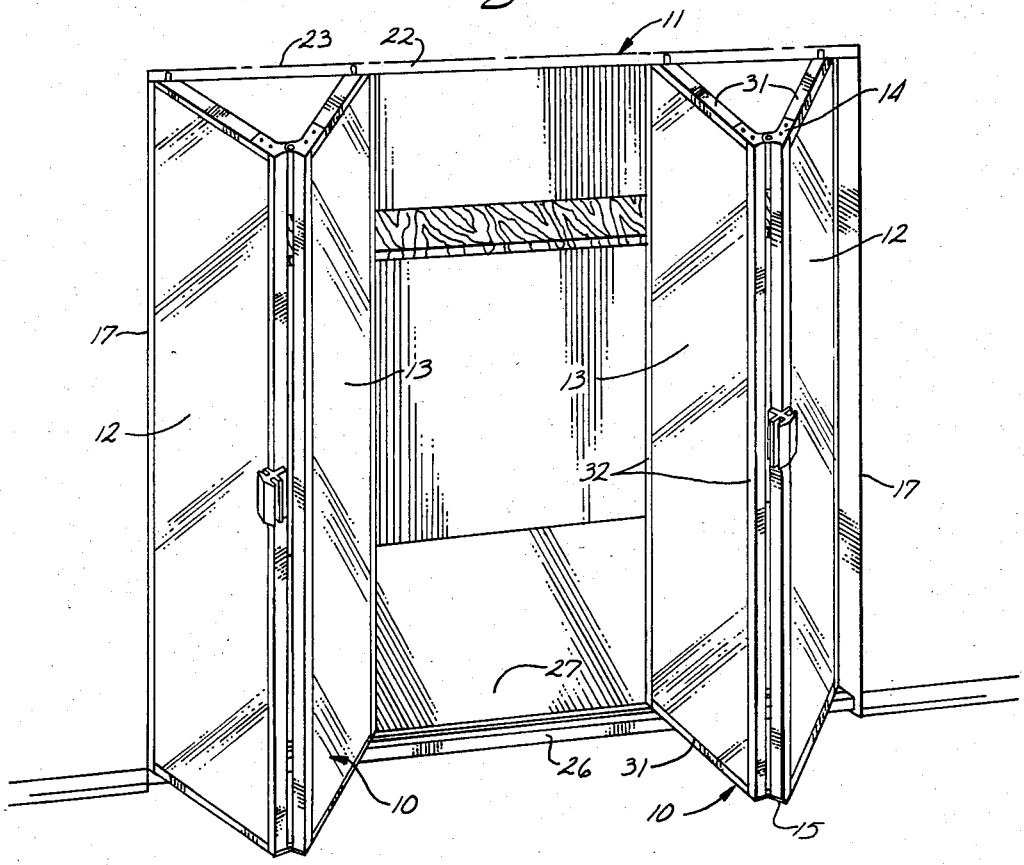
FIG. 1 is an isometric view of a bi-fold door system installed in a doorway.
Figure 2:
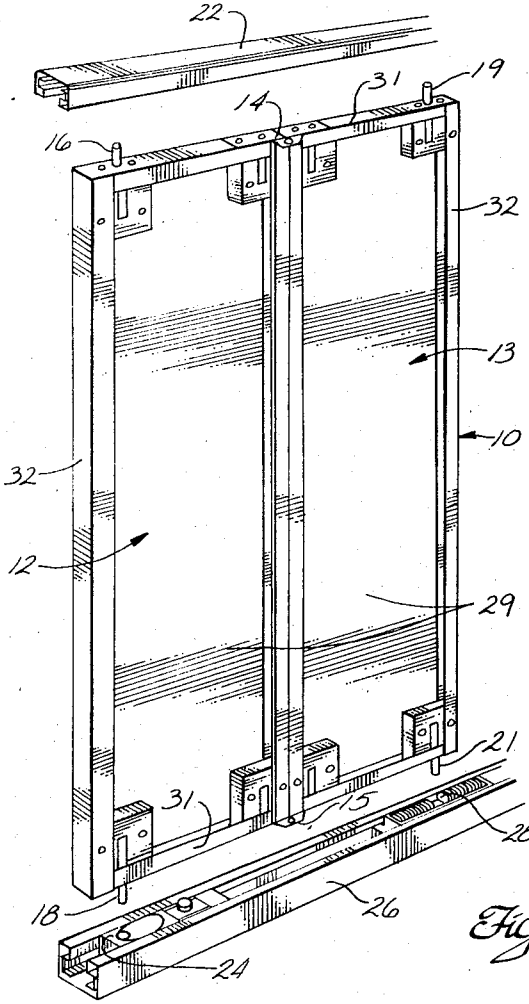
FIG. 2 is an exploded fragmentary view showing one-half of a bi-fold door system from the back of the panel doors.

With reference to FIGS. 1 and 2, the bi-fold door system comprising two allochiral bi-fold doors 10 installed in a doorway 11. The bi-fold doors each comprises a pivot door 12 and a guide door 13 which are connected by upper and lower hinges 14 and 15.

Each pivot door 12 comprises an upper spring-loaded pivot 16 extending upwardly from the upper corner of the pivot door adjacent the door jamb 17. Each pivot door also comprises a lower adjustable pivot 18 extending downwardly from the lower corner of the pivot door adjacent the door jamb 17. Each guide door 13 also comprises an upper spring-loaded pivot or guide 19 extending upwardly from the upper corner of the guide door nearer the center of the doorway and a lower spring loaded guide 21 extending downwardly from the lower corner of the guide door.

A portion of the upper pivot 16 of the pivot door 12 is inserted into and provides rotatable movement in a stationary pivot bracket (not shown) positioned in a top guide track 22 fixedly attached to the lintel 23 of the doorway. Likewise, a portion of the lower pivot 18 of the pivot door 12 is inserted and provides rotatable movement in a stationary pivot bracket 24 positioned in a floor track 26 fixedly attached to the floor 27 of the doorway.

A portion of the upper pivot 19 of the guide door 13 is inserted into and affords rotatable movement in a slidable slide guide (not shown) for slidable movement in the top guide track 22. A portion of the lower guide 21 of the guide door 13 is likewise inserted into and affords rotatable movement in a slidable slide guide 28 for slidable movement in the floor track 26. Such pivots, guides and tracks are conventional.

Each pivot and guide door comprises a mirror panel having a protective backing made of a plastic polyethylene sheet or other suitable safety material adhering to the glass. Around each mirror panel is a frame comprising upper and lower rails 31 for receiving the upper and lower edges of the mirror panel and two generally-vertical stiles 32 for receiving the lateral edges of the mirror panel. The upper and lower rails 31 have the same general configuration and the two side stiles 32 have the same general configuration.

Figure 3:
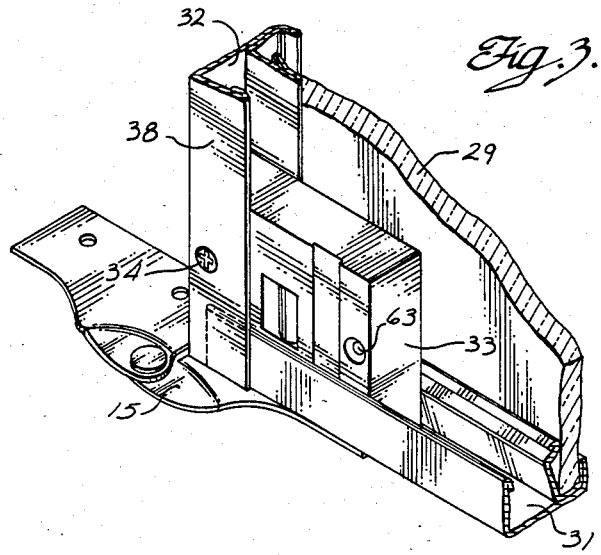
FIG. 3 is a fragmentary perspective view of the lower corner of a panel door showing a stile, a rail, a corner connector and hinge.

With reference to FIG. 3, each rail 31 and stile 32 forming a corner of the frame are interconnected by a plastic corner connector 33 located adjacent the rear side of the mirror panel. The corner connector is fixedly attached to the stile by a screw 34. The guide door 13 and pivot door 12 making up one bi-fold door 10 are connected by a lower hinge 15 positioned below the lower rail as shown and an upper hinge positioned above the upper rail. The hinge and rail are connected to the corner connector by screws (not shown). A similar corner connector is used in each corner of the panel door. In each of the two corners of the panel door farthest from the hinges, a pivot or guide is pressed through a hole in the rail into a cavity in the corner connector.

Figure 4:
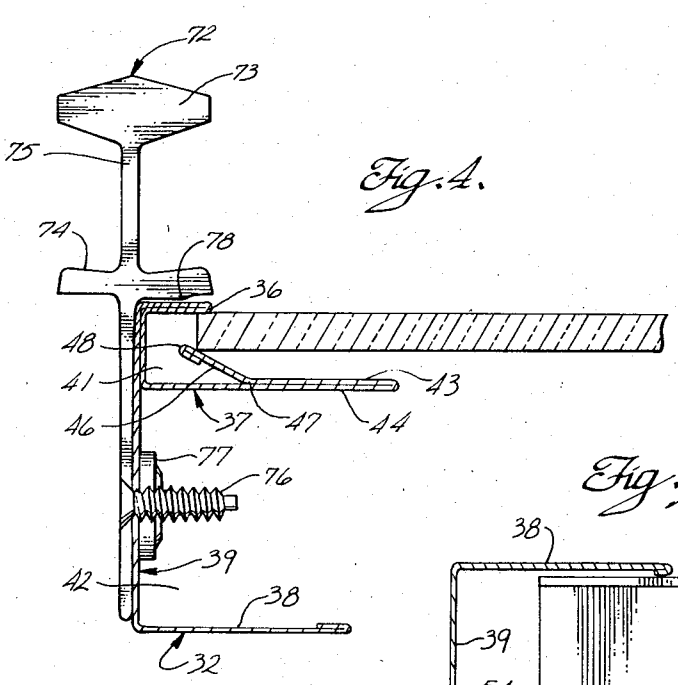
FIG. 4 is a transverse cross-sectional view of a preferred stile having a door pull attached and a mirror panel in position for installation.

Referring now to FIG. 4, the stile 32 has a generally "E" shaped transverse cross-section and includes a front wall 36, an intermediate wall 37 and a rear wall 38, each wall extending generally normal from a side wall 39. The front wall 36 is narrow and forms the face of the stile 32, i.e., the portion of the stile that is visible when the door is in a closed position. The front wall 36 and the intermediate wall 37 are spaced to form a front stile channel 41 sufficiently wide to receive the corresponding vertical edge of the mirror panel.

The intermediate wall and the rear wall are spaced to form a rear stile channel 42 providing rigidity to the stile. The width of the rear stile channel and the width of the rear wall are sufficient to substantially prevent twisting and crimping of the stile and to receive the corner connectors. The rear wall is wider than the front wall and the rear stile channel is wider than the front stile channel.

The intermediate wall 37 is substantially normal to the side wall 39 and is doubled-back on itself, forming a front side 43 nearer the front wall 36 and a rear side 44 nearer the rear wall 38. A portion of the front side of the intermediate wall forms a deflection arm 46 which extends from a pivot position 47 between the edges of the intermediate wall into the front stile channel 41 and forms an acute angle with the rear side 44 of the intermediate wall. The pivot position 47 is a greater distance from the side wall than the width of the front wall. The deflection arm extends from the pivot position at about the middle of the intermediate wall toward the intersection of the side wall 39 and front wall 36 forming a tapered opening for the front channel 41. The deflection arm extends into the front stile channel sufficiently so that the distance between the front wall 36 and the contact edge 48 of the deflection arm 46 is less than the thickness of the mirror panel to be inserted into the front stile channel. The distance between the contact edge of the deflection arm and the side wall is less than the width of the front wall.

In FIG. 4, the front side 43 of the intermediate wall is bent at the pivot position 47 in a clockwise direction to form the deflection arm. However, all bends can be reversed, e.g., a bend being counterclockwise rather than clockwise, to generate the same configuration.

The deflection arm 46 is capable of being elastically deflected toward the rear wall to accommodate insertion of an edge of the mirror panel into the front stile channel. When the deflection arm is deflected, the pivot angle, i.e., the small angle between the deflection arm and the rear side of the intermediate wall, decreases, but very little change occurs in the right angle between the side wall 39 and the rear side 44 of the intermediate wall. Very little movement in the form of bowing occurs in the intermediate wall and therefore the position of the interior edge of the intermediate wall is substantially static. This assures that there is no twisting of the side wall, and further it minimizes closing of the rear channel 42 which could limit introduction of the corner connectors into the rear channel. The deflection arm is resilient and therefore generates a return force against the mirror panel, thus holding it in place.

The deflection arm 46 is doubled-back on itself to provide a contact edge 48 with a smooth, rounded radius. The rolled-back edge is between the deflection arm and the rear side of the intermediate wall. When the mirror panel 29 is inserted into the front stile channel 41, the contact edge 48 of the deflection arm 46 is pressed into the mirror backing 49. By providing a contact edge having a smooth, rounded surface, the mirror panel may be removed without damaging the mirror or the backing.

The deflection arm presses the inserted mirror panel against the front wall to thereby grip the mirror panel. It is preferred that the contact edge of the deflection arm contacts the back of the mirror panel at a position between the edges of the front wall, i.e., closer to the side wall than the edge of the front wall nearer the center of the inserted panel. This provides a stable "three-point" contact between the stile and panel. The front wall is also doubled-back on itself to provide strength, rigidity and a smooth, attractive appearance to the edge of the front wall. The inserted edge of the mirror panel makes substantially flush contact with the front wall. This minimizes localized stress on the inserted edge of the mirror panel.

It is preferred that the angle between the front wall and the side wall be between about 85° and about 95°, and more preferably from about 88° to about 90° as measured through the front stile channel. This provides that the side wall will be approximately normal to the mirror panel.

The width of the front wall, and therefore the exposed face of the stile, is minimized to provide a larger mirror area. This is especially important for small doors or narrow doors wherein a large stile face area detracts from both the functionality of the mirror panel and the aesthetic appearance of the doors as a whole. Therefore, the width of the front wall is the minimum required to grip and maintain the vertical edge of the mirror panel. For example, a stile capable of accommodating a mirror panel having a thickness of about 4 millimeters would comprise a front wall having a width of about 8 millimeters.

As used herein, "grip" means a force exerted on the edge of the panel sufficient to hold the panel in place and to prevent the stile from being pulled away from the edge of the panel as a result of forces exerted on the stile and panel in normal use, e.g., if a force is exerted on the stile to open or close the door.

The portion of the side wall between the front wall and intermediate wall is doubled-back to provide added rigidity and to assure that the angle between the side walls and the front wall is maintained within the preferred ranges. This also permits the stile to be roll-formed from a single strip of steel.

The interior edge of the rear wall is also doubled-back on itself into the rear stile channel to provide added strength and rigidity and to eliminate exposed sharp edges.

Figure 6:
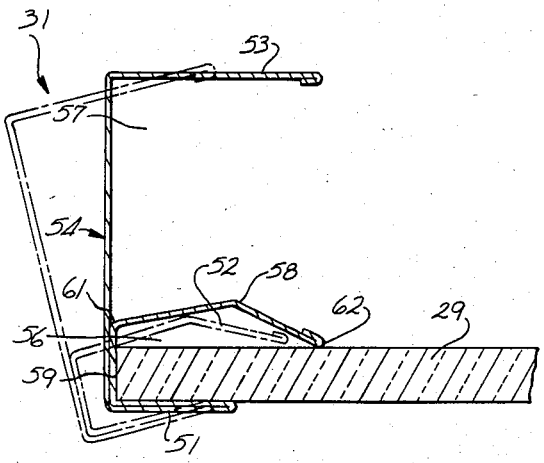
FIG. 6 is a transverse cross-sectional view of a preferred rail showing a mirror panel before and after installation.

With reference to FIG. 6, the rail 31 has a generally "E" shaped transverse in cross-section and comprises a side wall 54 and a front wall 51, an intermediate wall 52 and a rear wall 53 generally normal to the side wall 54 The front wall is narrow and forms the exposed face of the rail when installed on a panel. The front wall and the intermediate wall are spaced to form a front rail channel 56 sufficiently wide to receive the corresponding edge of the mirror panel 29.

The intermediate wall 52 and rear wall 53 are spaced to form a rear rail channel 57 to provide strength and rigidity to the rail. The width of the rear rail channel and the width of the rear wall are sufficient to substantially prevent twisting and crimping of the rail and to receive the corner connectors 33. The rear wall 53 and intermediate wall 52 are wider than the front wall 51 and the rear rail channel 57 is wider than the front rail channel 50.

Figure 5:
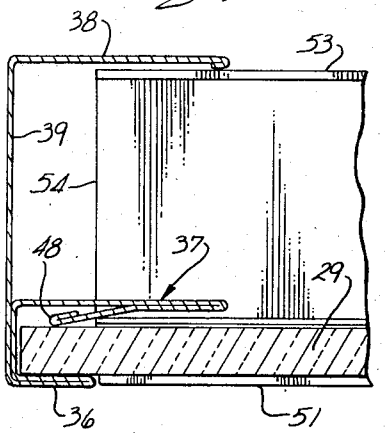
FIG. 5 is a cross-sectional view showing the relationship between the stile and rail at a corner.
Figure 7:
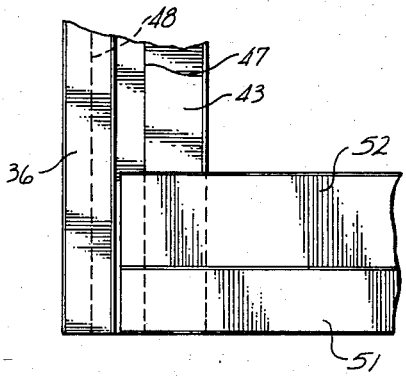
FIG. 7 is a fragmentary front view of a stile and rail showing the relationship of each to the other at a corner.

With reference to FIGS. 5 and 7, the widths of the front and rear rail channels enable the rail 31 to cooperate with the stile 32 at the corners of the frame wherein the intermediate wall 52 and rear wall 53 of the rail 31 overlap the intermediate wall 37 and rear wall 38 of the stile 32. The widths of the front and rear rail channels are selected so that the intermediate wall 52 of the rail at the end of the rail is positioned between the inserted mirror panel and the intermediate wall 37 of the stile, and the rear wall 53 of the rail is positioned in the rear stile channel adjacent to the rear wall 38 of the stile.

Again with reference to FIG. 6, the intermediate wall 52 of the rail extends generally normal to the side wall 54 adjacent the side wall. At a position intermediate its edges, the intermediate wall has a bend 58 at about the same distance from the side wall as the interior edge of the front wall. From the bend to its interior edge the intermediate wall extends away from the side wall and rear wall, i.e., toward the plane of the front wall, at an obtuse angle of about 20° (160°) from the balance of the intermediate wall. The entire intermediate wall 52 thus forms a deflection arm.

When the edge of a mirror panel 29 is inserted into the front rail channel 56, the entire intermediate wall acting as a deflection arm is elastically deflected toward the rear wall. The deflection arm maintains a generally-rigid shape throughout the deflection.

The portion of the side wall 54 between the front wall and the intermediate wall has double thickness. The inner side 59 of the side wall 54, i.e., the side closer to the mirror panel when inserted, is integral with the intermediate wall or deflection arm and forms a curved interconnection 61 with the deflection arm. Most of the deflection of the deflection arm is accommodated at the curved interconnection 61 by a decrease in the angle between the side wall 54 and the deflection arm 58 as measured through the rear rail channel 57. The resilience of the deflection arm causes it to exert a return force against the back of the mirror panel. The contact edge 62 of the deflection arm is doubled-back on itself away from the plane of the front wall to provide a smooth, rounded surface for contacting the backing 49 of the mirror panel 29.

The deflection arm of the rail does not exert as great a return force on the mirror panel as the deflection arm of the stile because there is less requirement for the rail to grip the mirror panel at the top and bottom edges as there is for the stile to grip the panel along its vertical edges. Although there is less need for the rail to grip the mirror panel and hence for the mirror panel to make a flush contact with the front wall of the rail, it is preferred that the angle between the front wall and side wall of the rail be between 85° and 95° to minimize gap between the front wall and the mirror panel.

It is also not as important that the width of the face, i.e., the front wall, of the rail be minimized as it is for the stile. This is because the doors are generally much longer than they are wide and the top and bottom of the panels are at the top and bottom of the door opening and far from eye level. Hence, wide rails do not have as great an impact on the appearance of the framing members.

The inner edge of the rear panel of the rail is also doubled-back on itself into the rear rail channel to provide added strength and rigidity to the rail and to eliminate exposed sharp edges.

Figure 8:
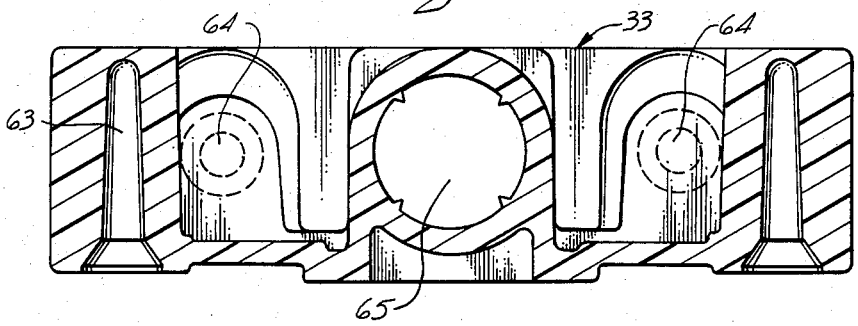
FIG. 8 is a cross-sectional view of a corner connector.

With reference to FIG. 3 and FIG. 8, the corner connector 33 is a symmetrical, generally box-like structure, portions of which are disposed in the rear stile channel 42 and rear rail channel 57.

The stile is attached to the corner connectors by screws 34. Attachment of the corner connector to the stile is made through the rear wall 38 of the stile 32, i.e., such a screw extends through a screw hole in the rear wall and is anchored in one of the corresponding screw holes 63 in the corner connector 33. Two screws (not shown) for attaching the corner connector 33 to the rail 31 extend through screw holes in the side wall 54 of the rail 31 and are anchored in corresponding screw holes 64 in the corner connector 33.

Each corner connector also has a pivot or guide hole 65 between the screw holes 64 used for attachment of the corner connector to the rail. The pivot hole 65 provides a means for anchoring upper and lower pivots and/or guides. The pivot or guides holes 65 of the corner connector are of sufficient diameter to enable the anchoring portion of the pivots and/or guides to be pressed into the holes and held tightly by the corner connector.

The ends of the rails at the corners of the guide and pivot doors having upper and lower pivots or guides include a hole between the screw holes sufficient for a portion of the pivot or guide to pass through the rail into the corner connector. The position of these holes in the rails corresponds to the position of the pivot holes 65 in the corner connector when the corner connector is installed.

The stiles are generally provided in lengths equal to that of the mirror panel while the rails are slightly shorter than the width of the mirror panel. For example, the stiles are cut to the standard length for a six foot, eight inch door and screw holes are punched at the appropriate distance from each end. Rails can be made in a number of standard lengths with prepunched screw holes and holes for the pivots. If shorter lengths are needed, the stiles or rails can be cut in the field and new holes punched. The usual mode of utilization of this hardware is at three locations. The stiles, rails, corner connectors, pivots, rails, etc., are made at the original manufacturer's factory and may be assembled into kits for a selected door size. Mirror panels and the framing hardware are acquired by local door manufacturers who assemble door sets at their facilities. The assembled door sets are delivered to a job site for installation. Any special cutting and punching of stiles or rails can readily be provided at the door manufacturers' facilities.

The stiles are generally installed on the mirror panel first. Installation is achieved by placing one end of the stile in one corner of the mirror panel until it contacts the deflection arm as shown in FIG. 4 and then tapping the stile onto the mirror panel starting at one end of the stile and working toward the other end. A rubber mallet or the like can be used. The converging throat of the front stile channel permits easy entry of the mirror panel. The spring action of the deflection arm tightly grips the edge of the panel and inhibits removal of the stile from the glass. For example, an eighteen inch wide, eight foot long sheet of 4 millimeters glass can be lifted by such an installed stile without slippage. Because of the geometry of the deflection arm, such tight gripping is achieved with a narrow front wall on the stile.

After both stiles have been installed, the rails are installed. The front rail channel is positioned over the edge of the mirror panel at an angle as shown in FIG. 6. The rail is then pressed onto the mirror panel so that the face of the rail is generally flush against the front of the mirror panel. The angle of insertion is small enough that the rear wall of the rail can easily fit into the rear channel of the stile at the corners of the frame.

The corner connectors are then installed in the rear rail channel and rear stile channel and attached to each by screws as previously described. Hinges are fastened to the door panels by screws which extend through the hinge and rail and are anchored by the corner connectors. The pivots or guides are pressed into and anchored by the corner connectors.

A particularly preferred embodiment comprises stiles and rails that have been roll-formed into the desired configuration from a prefinished steel strip. The presently preferred stiles and rails are constructed from cold-rolled steel having a thickness of between 0.016 inch and 0.021 inch and are fashioned to receive mirrored panels having a thickness of about 4 millimeters. In an exemplary embodiment, the edge of the intermediate wall of the rail is deflected about 1 millimeters. The edge of the deflection arm on the stile is deflected about the same. The deflection arm on the stile is much stiffer and provides tighter gripping of the glass.

Stiles and rails formed to receive 4 millimeter thick mirror panels can also accommodate panels from about 3 millimeters thickness to about 5 millimeters thickness. The front rail channel is sufficiently wide to accommodate such a thicker panel. The deflection arm of the rail is sufficiently close to the plane of the front wall to generate a return force against such a thinner panel yet is sufficiently flexible to accommodate the thicker mirrored panel without creating a return force against the mirror panel sufficient to crack the panel. The front stile channel is also sufficiently wide to accommodate such a thicker panel. However, the deflection arm of the stile may not extend sufficiently close to the front wall to generate a return force against 3 millimeter panel and may not be sufficiently flexible to enable insertion of a 5 millimeter panel without hazarding a return force sufficient to crack the mirror panel. However, the deflection arm of the stile can be plastically deformed to safely receive such a thinner or thicker mirrored panel.

The stile is preferably deformed to receive a thinner panel by bending the rear side of the intermediate wall away from the front wall at a position adjacent the pivot position. This increases the angle between the deflection arm and the portion of the rear side of the intermediate wall adjacent the side wall which results in the contact end of the deflection arm moving closer to the front wall.

To receive a thicker (5 millimeter) panel, the deflection arm of the stile is preferably bent toward the rear side of the intermediate wall sufficiently to plastically deform the deflection arm, thereby creating a larger opening into the front stile channel.

To open and close a bi-fold door, a door pull is attached to the stile of the pivot door that is adjacent to the guide door. As shown in FIG. 4, the door pull 72 is fastened to the side wall of the stile. Attachment is by a pair of screws 76 extending through the door pull and stile and anchored by a corresponding spring nut 77 in the rear stile channel. Typically, the door pull is attached at the job site.

The door pull extends from the stile in a direction generally normal to the face of the stile and has an outer cross-member 73 and an intermediate cross-member 74 extending laterally from a center support member 75. The outer cross-member is the portion of the door pull that is gripped when opening and closing the door.

The intermediate cross-member 74 generally extends in both directions from the support member 75 at a slight angle away from the plane of the face of the stile to provide clearance from the guide door and have a similar width gap from the face of the stile. However, a portion 78 of the intermediate cross-member adjacent the face of the stile of the pivot door extends in a direction normal to the support member and abuts the face of the stile so that the door pull can be positioned accurately and assembled quickly onto the stile.

In a closed position the guide door and pivot door are generally in a common plane with the hinged edges next to each other. The bi-fold door is opened by pulling the door pull in a direction generally normal to the plane of the doors, i.e., away from the doorway. As the bi-fold door is opened, the slide guides in which the upper and lower guides of the guide doors are inserted, slide toward the outer end of the upper and lower tracks until the guide door and pivot door are in a "V" shaped arrangement in which both doors extend outwardly from the doorway.

To close the bi-fold door, the door pull is moved toward the plane of the doorway until the guide and pivot doors are generally in a common plane.

Panel doors can be constructed with stiles that grip the edges of the door panel as described above. They offer a distinct advantage, particularly for doors with heavy panels such as mirror or glass doors. This allows a door pull to be attached to the stile for opening and closing the door.

Furthermore, the rear channels of the stiles and rails easily accept door stiffeners in the event they are desired, e.g., if a flexible door panel is used.

Whereas door panels constructed according to this invention are particularly suitable for use in folding door systems and sliding door systems, the panel doors are also applicable to hinged door arrangements. In fact, for some applications, the hinges can be attached directly to a corner connector as described above without any additional supporting means for the door.

The preceding description has been presented with reference to a presently preferred embodiment of the invention shown in the accompanying drawings. Workers skilled in the art and technology to which this invention pertains will appreciate that alterations and changes in the described structure can be practiced without meaningfully departing from the principles, spirit and scope of this invention. Accordingly, the foregoing description should not be read as pertaining only to the precise structures and procedures described, but rather should be read consistent with and as support for the following claims which are to have their fullest fair scope.

What is claimed is:

1. A framing member comprising:

a rigid flat side wall;

a rigid, flat, front wall along the front edge of the side wall and generally normal to the side wall; and a third wall generally normal to the side wall and sapced from the front wall to form a channel sufficiently wide to receive the edge of a door panel and comprising a flexible deflection arm extending from a pivot position between the edges of the third wall toward the front wall and side wall which generates a force against the back face of a door panel at a position nearer the side wall than the edge of the front wall remote from the side wall when an edge of such a door panel is inserted in the channel, and wherein the ratio of the width of the front wall to the width of the channel is no more than about 3:1.

2. A door framing member formed from a metal strip having a uniform thickness comprising:

a rigid, flat side wall;

a front wall generally normal to the side wall and having a thickness about twice the strip thickness at least adjacent the side wall; and a third wall having a width greater than the width of the front wall which is generally normal to the side wall and spaced apart from the front wall to form a channel sufficiently wide to receive the edge of a door panel and having a thickness adjacent the side wall about equal to the strip thickness and comprising a deflection arm, at least a portion of which is of about the strip thickness extending from a pivot position intermediate the edges of the third wall and converging with the front wall to form a tapered opening into the channel, for elastic deflection by and generation of a return force against a door panel having an edge inserted into the channel.

3. A framing member as claimed in claim 2 wherein the ratio of the width of the front wall to the width of the channel is no more than about 3:1.

4. A framing member as claimed in claim 2 wherein the distance between the edge of the deflection arm remote from the pivot position and the side wall is less than the width of the front wall.

5. A framing member formed from a metal strip having a single thickness comprising a side wall, a front wall and third wall generally normal to the side wall, wherein the front wall and third wall are spaced apart to form a channel sufficiently wide to receive the edge of a door panel, and the front wall and the portion of the side wall between the front wall and third wall comprise a double thickness, and wherein the third wall has a single thickness at least adjacent the side wall and forms a deflection arm which is generally normal to the side wall adjacent the side wall and which is bent at poaition between its edges and has a portion beyond the bend extending away from the side wall and toward the plane of the front wall for generating a force against the back face of a door panel having an edge inserted into the channel and wherein the ratio of the width of the front wall to the width of the channel is no more than about 3:1.

6. A framing member having a generally "E" shaped transverse cross section comprising a side wall and front, intermediate and rear walls generally normal to the side wall wherein the front wall and intermediate wall are spaced apart to form a front channel sufficiently wide to accept the edge of a door panel and wherein the intermediate wall is wider than the front wall and comprises a resilient deflection arm extending from a pivot position between the edges of the intermediate wall and which is elastically deflected by and which generates a return force against a door panel having an edge inserted into the front channel and wherein the ratio of the width of the front wall to the width of the front channel is no more than 3:1.

7. A framing member as claimed in claim 6 wherein the front wall and the deflection arm converge to form a tapered opening into the front channel.

8. A framing member as claimed in claim 6 wherein the return force is sufficient to grip the edge of the door panel without damaging the door panel.

9. A framing member having a generally "E" shaped transverse cross section comprising a generally flat side wall and generally flat front, intermediate and rear walls generally normal to the side wall wherein the front wall and intermediate wall are spaced apart to form a front channel sufficiently wide to receive an edge of a door panel having a selected thickness and the intermediate wall comprises a resilient deflection arm which extends from a pivot position between the ends of the intermediate wall toward the side wall and front wall and into the front channel sufficiently to be deflected at the pivot position by an edge of a door panel of the selected thickness inserted into the front channel and to generate a return force against said door panel sufficient to grip the edge of the door panel without damaging it.

10. A framing member as claimed in claim 9 wherein the distance between the pivot position and the side wall is greater than the width of the front wall.

11. A framing member as claimed in claim 9 wherein the distance between the contact edge of the deflection arm and the side wall is less than the width of the front wall when the edge of a door panel of the selected thickness is inserted into the front channel.

12. A framing member as claimed in claim 11 wherein the distance between the pivot position and the side wall is greater than the width of the front wall.

13. A framing member as claimed in claim 9 wherein the intermediate wall and rear wall are wider than the front wall.

14. A framing member as claimed in claim 9 wherein the angle between the side wall and the front wall measured through the front channel is from about 85° to about 95°.

15. A framing member as claimed in claim 9 wherein the angle between the side wall and the front wall measured through the front channel is from about 88° to about 90°.

16. A framing member as claimed in claim 9 wherein the deflection arm comprises a smooth, rounded contact edge for contacting the rear face of a door panel inserted into the front channel.

17. A framing member as claimed in claim 9 wherein the front channel is sufficiently wide to receive the edge of a door panel having a thickness greater than the selected thickness and the deflection arm is capable of being plastically deformed sufficiently to be deflected by and to generate a sufficient return force against such a door panel thicker than the selected thickness.

18. A framing member having a generally "E" shaped transverse cross section comprising a generally flat side wall and front, intermediate and rear walls generally normal to the side wall wherein the front wall and intermediate wall are spaced apart to form a front channel sufficiently wide to receive the edge of a door panel having a selected thickness and wherein the intermediate wall is wider than the front wall and forms a deflection arm which is generally normal to the side wall adjacent the side wall and is bent at a position between its edges and has a portion beyond the bend extending away from the rear and side walls sufficiently to be deflected by and to generate a return force against a door panel of the selected thickness having an edge inserted into the front channel.

19. A framing member as claimed in claim 18 wherein the side wall forms a curved interconnection with the intermediate wall.

20. A framing member as claimed in claim 18 wherein the angle between the side wall and the front wall measured through the front channel is from about 85° to about 95°.

21. A framing member as claimed in claim 18 wherein the deflection arm comprises a smooth, rounded contact edge for contacting the rear face of a door inserted into the front channel.

22. A framing member as claimed in claim 18 wherein the front channel is sufficiently wide to receive the edge of a door panel having a thickness greater than the selected thickness and the deflection arm is sufficiently flexible to be deflected by and to generate a return force against said door panel without damaging the door panel.

23. In a framing member having a generally "E" shaped transverse cross section comprising a generally flat side wall and front, intermediate and rear walls generally normal to the side wall wherein the front wall and intermediate wall are spaced apart to form a front channel sufficiently wide to receive an edge of a door panel, the improvement wherein the intermediate wall comprises a resilient deflection arm extending from a pivot position between the edges of the intermediate wall toward the front wall and side wall and into the front channel sufficiently that the distance between the contact edge of the deflection arm and the side wall is less than the width of the front wall when the edge of a door panel is disposed in the front channel which is deflectable by and which generates a return force against a door panel having an edge disposed in the front channel.

24. An elongated framing member for a panel door frame comprising:

a generally flat side wall;

a generally flat front wall normal to the side wall;

a rear wall normal to the side wall and spaced apart from the front wall;

an intermediate wall generally normal to the side wall adjacent the side wall and between the front wall and rear wall forming a generally E-shaped transverse cross section of the framing member and defining a front channel between the front wall and the intermediate wall and a rear channel between the intermediate wall and the rear wall and comprises a first section extending normal to the side wall and a second section in face-to-face relation to the first section extending from the edge of the intermediate wall remote from the side wall toward a pivot position between the edges of the intermediate wall and a third section forming a spring means extending from the pivot position toward the side wall and toward the front wall to a contact edge a shorter distance from the plane of the front wall than the width of the front channel adjacent the side wall.

25. A framing member as claimed in claim 24 wherein the contact edge is a shorter distance from the side wall than the width of the front wall.

26. A framing member as claimed in claim 25 wherein the pivot position is a greater distance from the side wall than the width of the front wall.

27. A framing member for a door panel comprising a single elongated metal strip roll-formed into a configuration having a generally "E" shaped transverse cross section comprising side, front, intermediate and rear walls wherein the side wall comprises a first section which bends at its rear edge along its length about 90° in a counterclockwise direction to form a first section of the rear wall which extends generally normal to the side wall a selected distance and then bends along its length about 180° in a counterclockwise direction to form a second section of the rear wall which extends in face-to-face arrangement with the first rear wall section for a distance shorter than the width of the first rear wall section, and wherein the first side wall section bends at its front edge along its length about 90° in a clockwise direction to form a first section of the front wall forming the face of the framing member which extends generally normal to the side wall a distance shorter than the width of the rear wall and then bends along its length about 180° in a clockwise direction to form a second section of the front wall which extends in face-to-face arrangement with the first front wall section to the first side wall section, wherein the second front wall section bends along its length about 90° in a counterclockwise direction to form a second section of the side wall which extends in face-to-face arrangement with the first side wall section for a distance less than half the width of the first side wall section and then bends along its length about 90° in a counterclockwise direction to form a first section of the intermediate wall which extends generally normal to the side wall for a distance greater than the width of the front wall and then bends along its length about 180° in a counterclockwise direction to form a second section of the intermediate wall which extends in face-to-face arrangement with the first intermediate wall section to a pivot position which is a greater distance from the side wall than the width of the front wall and wherein the second intermediate wall section bends along its length at an acute angle from the first intermediate wall section in a clockwise direction to form a third section of the intermediate wall which forms a deflection arm which extends to a contact edge which is a lesser distance from the side wall than the width of the front wall and a lesser distance from the front wall than the length of the second side wall section and wherein the third intermediate wall section bends along the width of its contact edge about 180° in a counterclockwise direction to form a fourth section of the intermediate wall which extends in face-to-face arrangement with the third intermediate wall section for a distance less than the width of the third intermediate wall section.

28. A framing member for a door panel comprising a single elongated metal strip roll-formed into a configuration having a generally "E" shaped transverse cross section comprising a generally flat front wall, an intermediate wall, a rear wall and a side wall wherein the side wall comprises a first section which bends at its rear edge along its length about 90° in a counterclockwise direction to form a first section of the rear wall which extends generally normal to the side wall a selected distance and then bends along its length about 180° in a counterclockwise direction to form a second section of the rear wall which extends in face-to-face arrangement with the first rear wall section for a distance shorter than the width of the first rear wall section and wherein the first side wall section bends at its front edge along its length about 90° in a clockwise direction to form a first section of the front wall forming the face of the framing member which extends generally normal to the side wall a distance shorter than the width of the rear wall and then bends along its length about 180° in a clockwise direction to form a second section of the front wall which extends in face-to-face arrangement with the first front wall section, to the first side wall section, and wherein the second front wall section bends along its length about 90° in a counterclockwise direction to form a second section of the side wall which extends in face-to-face arrangement with the first side wall section for a distance less than half the width of the first side wall section and then bends along its length about 90° in a counterclockwise direction to form a first section of the intermediate wall which extends generally normal to the side wall for a distance about the width of the front wall and then bends along its length in a counterclockwise direction to form a second section of the intermediate wall which extends at an obtuse angle from the first section of the intermediate wall to a contact edge which is a lesser distance from the plane of the front wall than the width of the second side wall section and wherein the second intermediate wall section bends along the length of its contact edge about 180° in a clockwise direction to form a third section of the intermediate wall which extends in face-to-face arrangement with the second intermediate wall section for a distance less than the width of the second intermediate wall section.

29. A panel door comprising:

a generally rectangular door panel;

four frame members, each having a generally "E" shaped cross section comprising a side wall and spaced apart front, intermediate and rear walls extending generally normal to the side wall wherein the edges of the door panel are disposed in the space between the front wall and intermediate wall and the ratio of the width of the front wall to the thickness of the door panel is equal to or less than about 3:1 and wherein the intermediate wall of at least two opposing framing members comprises a resilient deflection arm extending from a pivot position between the edges of the intermediate wall toward the front wall and side wall and into the front channel which is deflected by and which generates a return force against the door panel; and four corner connectors behind the door panel, each connector rigidly connecting two adjacent frame members forming a corner.

30. A panel door as claimed in claim 29 wherein the intermediate wall of at least two opposing framing members forms a deflection arm which is bent at a position between its edges and extends from the bend away from the rear wall and the side wall.

31. A panel door as claimed in claim 29 wherein the door panel is a mirror panel.

32. A panel door comprising:

a generally-rectangular door panel;

a pair of stiles, each having a generally "E" shaped transverse cross section comprising a generally flat side wall and spaced apart front, intermediate and rear walls extending generally normal to the side wall and wherein a vertical edge of the door panel is disposed in the space between the front and intermediate wall and wherein the intermediate wall comprises a resilient deflection arm extending from a pivot position between the edges of the intermediate wall toward the side wall and front wall sufficiently to be deflected by and to generate a return force against the door panel;

a pair of rails, each having a generally "E" shaped transverse cross section comprising a generally flat side wall and spaced apart front, intermediate and rear walls extending generally normal to the side wall wherein a horizontal edge of the door panel is disposed in the space between the the front wall and intermediate wall and wherein the intermediate wall forms a deflection arm which is bent at a position between its edges and extends from the bend away from the rear wall and side wall sufficiently to be deflected by and to generate a return force against the door panel; and four corner connectors comprising means for rigidly attaching each connector to an adjacent stile and rail, each corner connection rigidly connecting a stile and rail forming a corner of the panel door.

33. A panel door as claimed in claim 32 wherein the distance between the contact edge of the deflection arm of the stile and the side wall of the stile is less than the width of the front wall of the stile.

34. A panel door as claimed in claim 32 wherein the distance between the pivot position and the side wall of the stile is greater than the width of the front wall of the stile.

35. A panel door as claimed in claim 32 wherein the angle between the side wall of the stile and the front wall of the stile is from about 85° to about 95°.

36. A panel door as claimed in claim 32 wherein the side wall of the rail forms a curved interconnection with the intermediate wall of the rail.

37. A panel door as claimed in claim 32 wherein the angle between the side wall of the rail and the front wall of the rail is from about 85° to about 95°.

38. A panel door as claimed in claim 32 wherein the door panel is a mirror panel.

39. A panel door as claimed in claim 32 wherein the intermediate wall and rear wall of the rail overlap the intermediate wall and rear wall of the stile at each corner and wherein the portion of the intermediate wall of the rail that overlaps the intermediate wall of the stile is positioned between the rear face of the door panel and the intermediate wall of the stile and the portion of the rear wall of the rail that overlaps the rear wall of the stile is positioned adjacent the rear wall of the stile in the space between the rear wall and intermediate wall of the stile.

40. A hardware kit for a panel door comprising:

a pair of stiles each having a generally "E" shaped transverse cross section comprising a generally flat side wall and front, intermediate and rear walls extending generally normal to the side wall wherein the front and intermediate walls are spaced apart to form a front stile channel sufficiently wide to accept an edge of a door panel and wherein the intermediate wall comprises a resilient deflection arm extending from a pivot position between the edges of the intermediate wall toward the side wall and front wall and into the front stile channel sufficiently to be deflected by and to generate a return force against an edge of a door panel inserted into the front stile channel;

a pair of rails having a generally "E" shaped transverse cross section comprising a generally flat side wall and front, intermediate and rear walls extending generally normal to the side wall wherein the front wall and intermediate wall are spaced apart to form a front rail channel sufficiently wide to accept an edge of a door panel and wherein the intermediate wall forms a deflection arm which is bent at a position between its edges and extends from the bend away from the rear and side wall sufficiently to be deflected by and to generate a return force against a door panel having an edge inserted into the front rail channel; and four corner connectors comprising means for rigidly attaching each connector to an adjacent stile and rail for forming a corner of a panel door.

41. A hardware kit as claimed in claim 40 wherein the distance between the contact edge of the deflection arm of the stile and the side wall of the stile is less than the width of the front wall of the stile when the edge of a door panel is inserted into the front stile channel.

42. A hardware kit as claimed in claim 40 wherein the distance between the pivot position and the side wall of the stile is greater than the width of the front wall of the stile.

43. A hardware kit as claimed in claim 40 wherein the angle between the side wall of the stile and the front wall of the stile measured through the front stile channel is from about 85° to about 95°.

44. A hardware kit as claimed in claim 40 wherein the angle between the side wall of the rail and the front wall of the rail measured through the front rail channel is from about 85° to about 95°.

45. A hardware kit as claimed in claim 40 wherein the intermediate wall and the rear wall of a rail overlap the intermediate wall and rear wall of a stile when said rail and stile are assembled to form a corner and wherein the overlapping portion of the intermediate wall of the rail is positioned in the front stile channel and the overlapping portion of the rear wall of the rail is positioned adjacent the rear wall of the stile between the rear wall and the intermediate wall of the stile.

46. A plurality of parts for framing a door panel comprising at least a pair of stiles, at least a pair of rails and at least four corner connectors for connecting each end of a rail to an adjacent stile, wherein the stiles comprise:

a generally flat side wall;

a rigid front wall along the front edge of the side wall and generally normal to the side wall; and a third wall generally normal to the side wall and spaced from the front wall to form a channel sufficiently wide to receive the edge of a door panel and comprising a flexible deflection arm which extends into the channel from a pivot position between the edges of the third wall and which is deflected by and generates a force against the back face of a door panel at a position nearer the side wall than the edge of the front wall remote from the side wall when an edge of such a door panel is inserted in the channel, and wherein the width of the front wall to the width of the channel is no more than about 3:1.

* * * * *

UNITED STATES PATENT AND TRADEMARK OFFICE

CERTIFICATE OF CORRECTION

PATENT NO. : 4,631,894
DATED : December 30, 1986
INVENTOR(S) : Torsti T.T. Jerila It is certified that error appears in the above-identified patent and that said Letters Patent is hereby corrected as shown below:

Column 10, line 22 "sapced" should read -- spaced --.

Column 11, line 4, "poaition" should read -- a position --.

Signed and Sealed this

Thirteenth Day of October, 1987

*Attest:*

DONALD J. QUIGG

*Attesting Officer*

*Commissioner of Patents and Trademarks*